US006053744A

United States Patent [19]

Gray et al.

[11] Patent Number: 6,053,744

[45] Date of Patent: Apr. 25, 2000

[54] RADIO FREQUENCY CONNECTOR TO PRINTED CIRCUIT BOARD ADAPTER

[75] Inventors: Ian James Staffordrd Gray, Winchester; Derek Andrews, Basingstoke, both of United Kingdom

[73] Assignee: ITT Manufacturing Enterprises, Inc., Wilmington, Del.

[21] Appl. No.: 09/340,494

[22] Filed: Jun. 30, 1999

Related U.S. Application Data

[63] Continuation of application No. 09/041,153, Mar. 9, 1998.

[51] Int. Cl.[7] ..... H01R 9/09

[52] U.S. Cl. ..... 439/63; 439/931

[58] Field of Search ..... 439/63, 83, 581, 439/931

[56] References Cited

U.S. PATENT DOCUMENTS

| | | | |
|---|---|---|---|
| 4,453,796 | 6/1984 | Monroe | 439/581 |
| 4,548,453 | 10/1985 | Mummey et al. | 439/17 |
| 4,598,961 | 7/1986 | Cohen | 439/63 |
| 5,145,382 | 9/1992 | Dickerson | 439/931 |
| 5,147,209 | 9/1992 | Litwin et al. | 439/70 |
| 5,158,465 | 10/1992 | Zaderej et al. | 439/668 |
| 5,228,871 | 7/1993 | Goodman | 439/581 |

*Primary Examiner*—Steven L. Stephan
*Assistant Examiner*—J. F. Duverne
*Attorney, Agent, or Firm*—Thomas L. Peterson

[57] ABSTRACT

An adapter for connection of an RF connector to a printed circuit board (PCB), the adapter comprising a plastics body adapted to mate with an RF connector, one or more contacts for electrical connection with the RF connector upon mating therewith and one or more attachment means disposed so as to permit connection to tracks on a printed circuit board, wherein coupling between each contact and an associated attachment means is effected via a conductive layer provided on the surface of the body.

4 Claims, 5 Drawing Sheets

RADIO FREQUENCY CONNECTOR TO PRINTED CIRCUIT BOARD ADAPTER

CROSS REFERENCE

Figure 3:
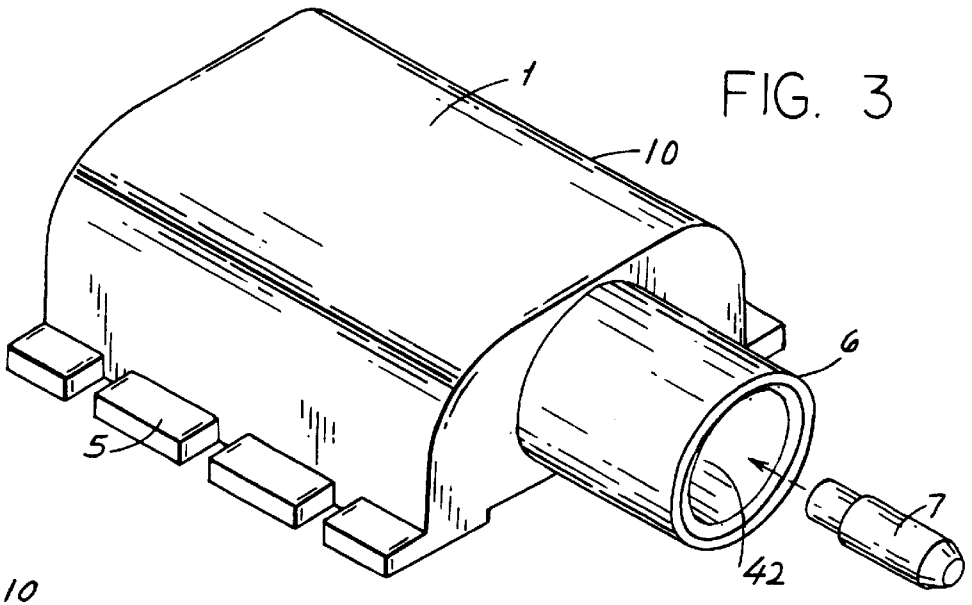

This application claims priority from British patent application No. 9705378.9 filed Mar. 14, 1997, and is a continuation of U.S. Ser. No. 09/041,153 filed Mar. 9, 1998.

The present invention relates to an adapter for attaching to a printed circuit board (PCB) that facilitates the production of an electrical interface between the PCB and one or more radio frequency (RF) connectors.

Presently, one method of connecting RE connectors to printed circuit boards uses right angle connectors that mate directly with a plated through hole in the PCB and/or are soldered to a printed circuit track on one side of the board. It is expensive to produce the right angled body for the connector and it is also difficult to fit an electrical contact bent at 90° into the body. These problems have previously been overcome by producing the right angled body in more than one piece and fitting it together after the contact is inserted. A further problem is encountered if two or more right angle connectors are stacked one above another. The mating end of a right angled connector stacked on top of another of the same size would not be coplanar with the PCB and therefore mating would not be possible. In this situation special connectors must be produced, each level of stacking requiring a specialised connector.

Another way of making connection to PCB's uses an adapter mounted onto the PCB having an opposite mating piece to that of an RE connector. The mating part of the adapter is commonly at 90° to the PCB mounting so that when an RF connector is mated with the adapter, the mating pressure is not applied directly to the PCB. To allow the mating part of the adapter to be at right angles to the PCB mounting, the electrical contact(s) in the adapter connecting the mating part to the PCB mounting have to bend through 90° as in the right angled connectors above, posing the same problems.

In addition, the adapters have to be assembled from parts, since the electrically conductive and insulating parts have to be produced from different materials.

The present invention seeks to simplify or reduce the cost of manufacture of connectors and may reduce the part count of the previously mentioned connectors and adapters.

According to the invention there is provided an adapter for connection of an RF connector to a printed circuit board (PCB), the adapter comprising a plastics body adapted to mate with an RF connector, one or more contacts for electrical connection with the RF connector upon mating therewith and one or more attachment means disposed so as to permit connection to tracks on a printed circuit board, wherein coupling between each contact and an associated attachment means is effected via a conductive layer provided on the surface of the body. The adapter may be adapted to mate with a plurality of RF connectors and having for each connector one or more contacts for electrical connection with the RF connector upon mating therewith and one or more attachment means disposed so as to permit connection to tracks on a printed circuit board, wherein coupling between each contact and an associated attachment means is effected via a conductive layer provided on the surface of the body. The conductive layers may be provided on the surface of the body by selective plating.

In one version of the adapter wherein for the or each RF connector a bore is provided in the inside of the body which bore is plated to form a female contact for engagement by a male contact of an RF connector, which plated bore adjoins the, or one of the, conductive layer(s). A male or female contact may be secured in the or each plated bore to permit engagement by a respective female or male contact of an RF connector. The or each plated bore may be a through hole in electrical communication at one end with the contact and at the other end with an associated conductive layer.

One or more plastics projection may be provided at one end of the body the or each of which projection is plated together with the conductive layers, one of which layers adjoins the plated projection and is in electrical communication therewith. For each projection a bore may be provided through the body and through the projection which bore is plated to form a plated through hole in electrical communication at one end with the plated projection and at the other end with an associated conductive layer.

The or each plated bore may adjoin an associated one of the conductive layers at the contact end, which conductive layer extends over an outer surface of the body to the associated attachment means.

In a particularly advantageous embodiment the adapter may comprise two coaxial contacts for the, or for each of the, RF connector(s).

The adapter may comprise, for each RF connector, two coaxial contacts the outer one of which contacts is formed by a cylindrical projection. Wherein the inner and/or outer surface of the or each cylindrical projection may be plated to provide one of the contacts. Preferably, a major part of the outer surface of the plastics body is plated and extends to the plating on the surface of the cylindrical projection and to an associated attachment means.

The body may have oppositely disposed surfaces and for the, or each, RF connector a through hole to receive a pin of the RF connector inserted from one side, the other side of which body is provided with the conductive layer which extends to the associated attachment means. For each RF connector there may be provided a plurality of through holes each for receiving a pin of the connector inserted from one side, and the other side of the body is provided with the conductive layers which extend to the associated attachment means. The or each conductive layer may be in the form of a track and the attachment means is/are formed by the end of the track(s). Alternatively, the or each conductive layer may be in the form of a track and the attachment means is/are formed by a pin. The ends of the attachment means are preferably coplanar.

The body on said one side may have a fully plated surface for connection to the body of one or more coaxial connector (s) mated therewith. The plated surface on said one side may be recessed to receive the or each coaxial connector. The plated surface on said one side may be linked to a conductive track on the other side via a plated through hole or slot which track extends to an associated attachment means.

Figure 1A:
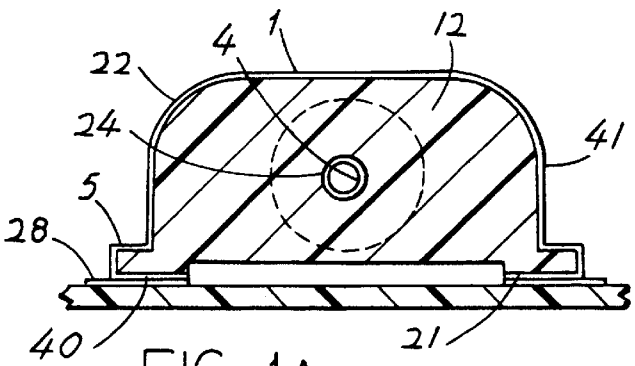
Figure 1:
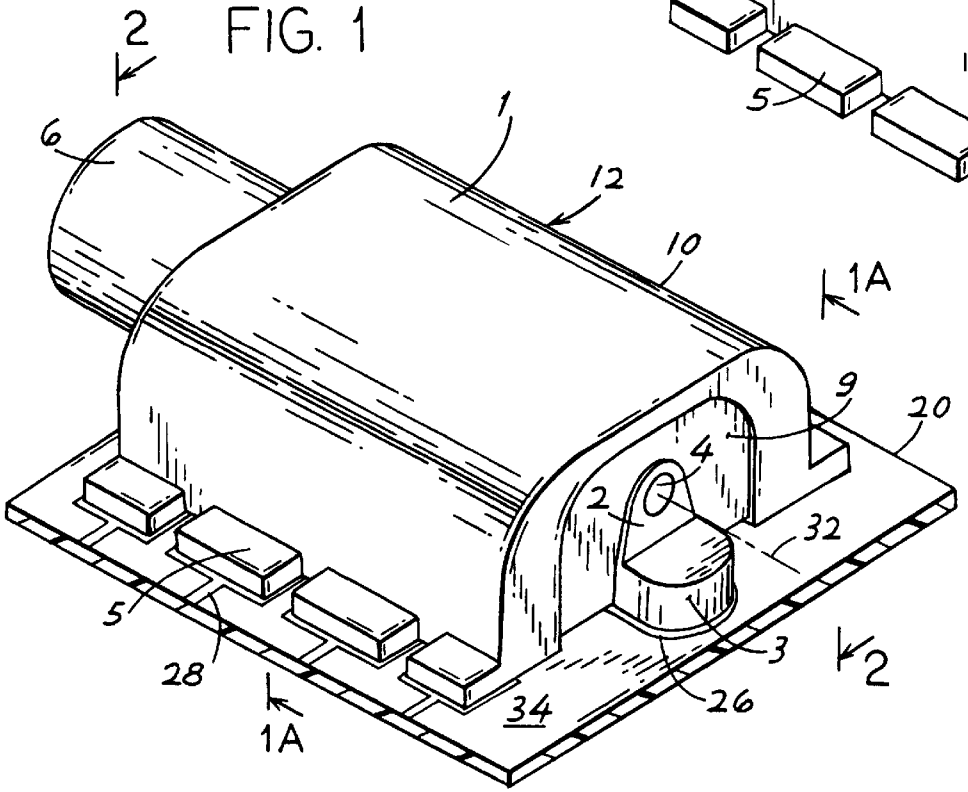

In order that the invention and its various other preferred features may be understood more easily, embodiments thereof will now be described, by way of example only, with reference to the accompanying drawings, in which:

FIG. 1 is an isometric elevational view of an adapter constructed in accordance with the invention, FIG. 1A is a view taken on line 1A—1A of FIG. 1 and showing the adaptor mounted on a circuit board.

Figure 2:
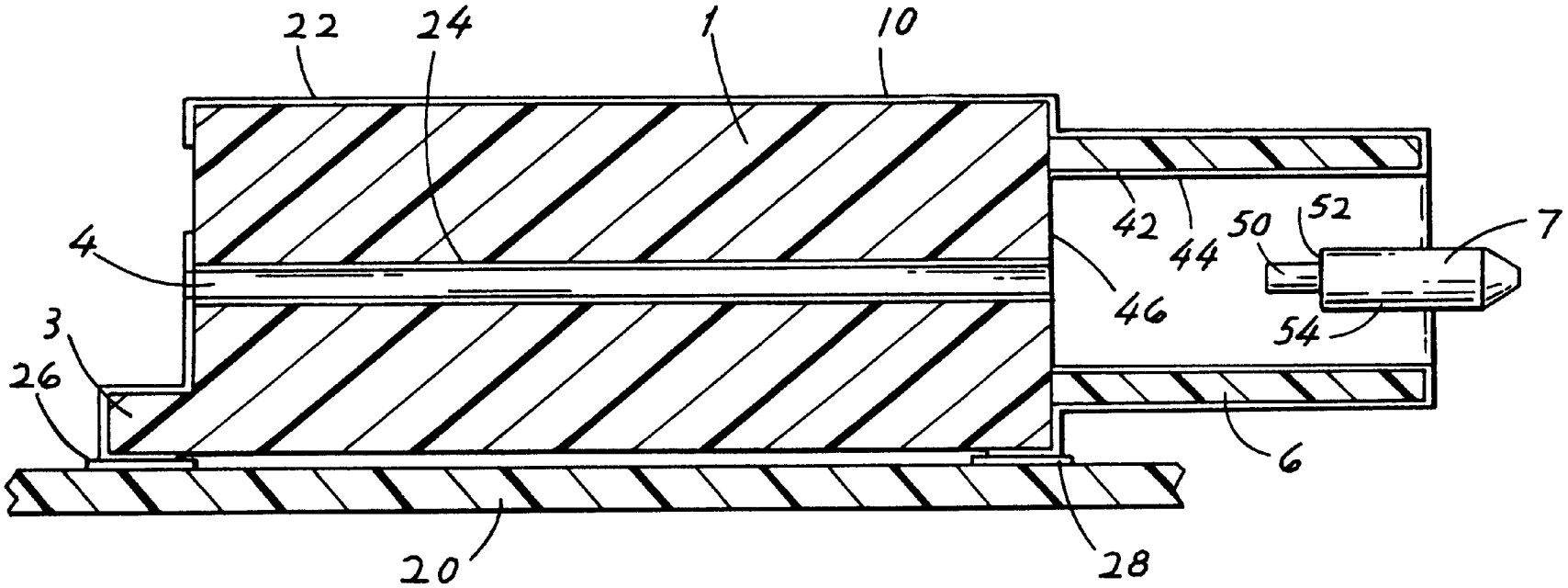
Figure 4:
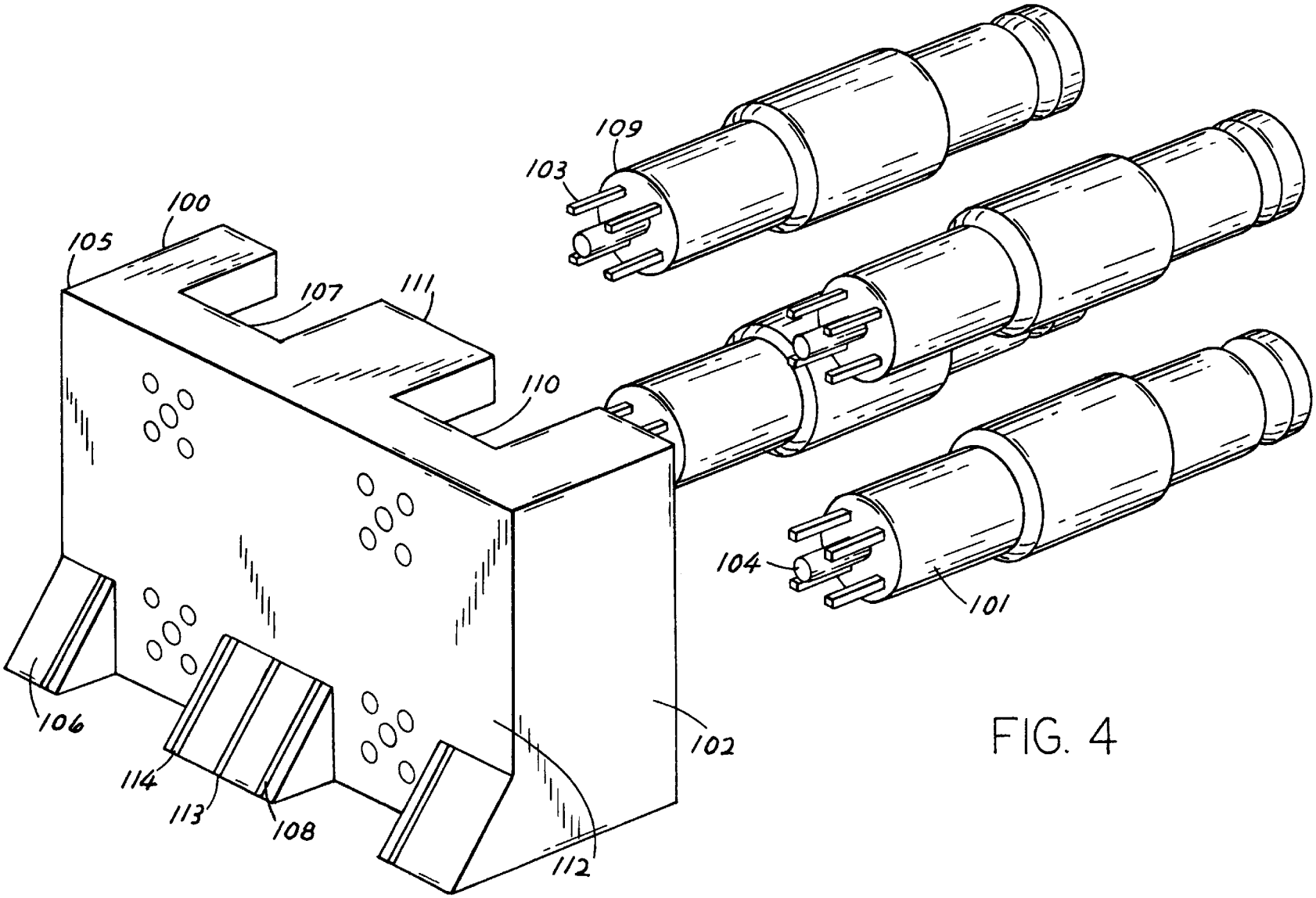
Figure 5:
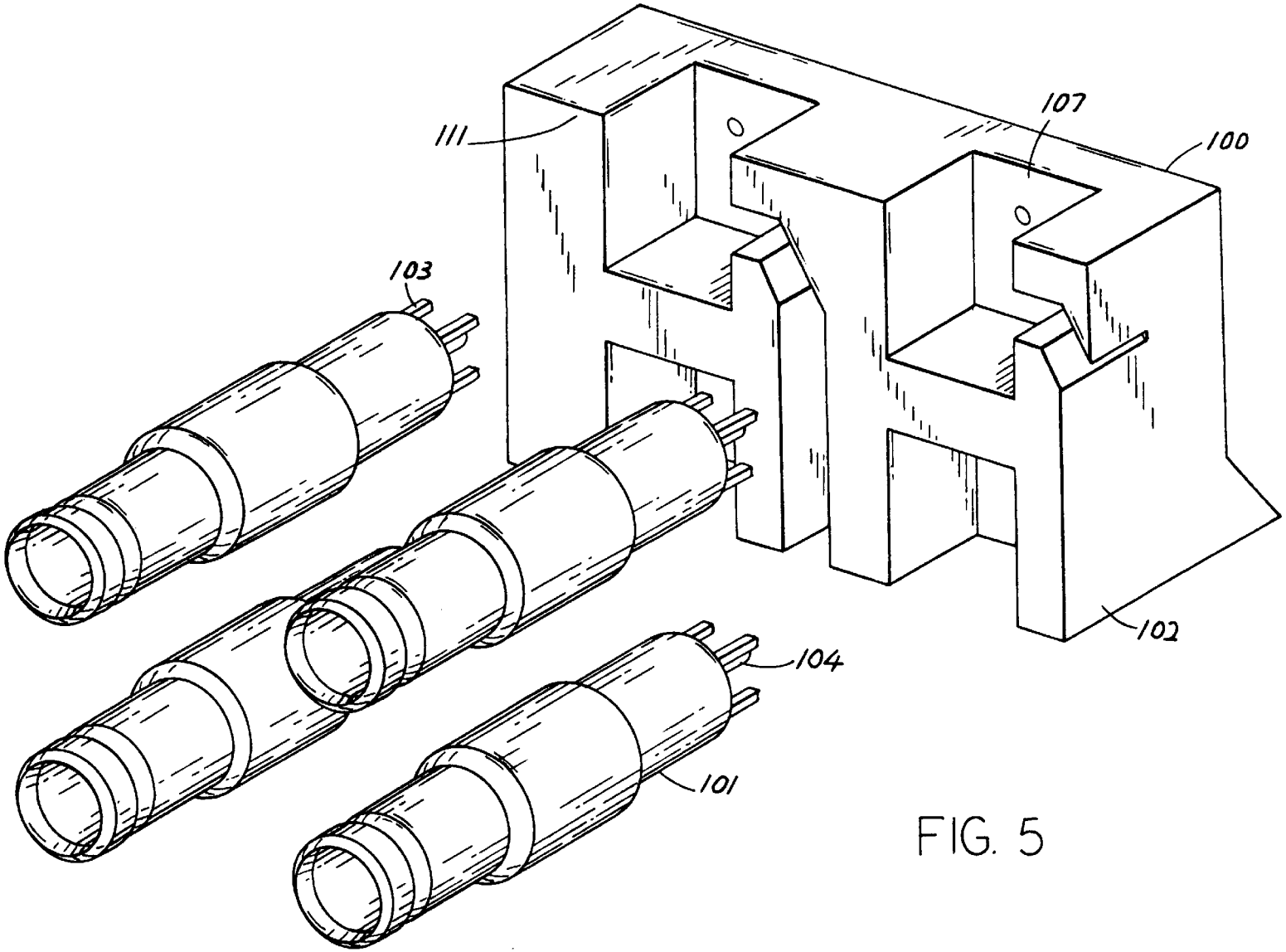
Figure 7:
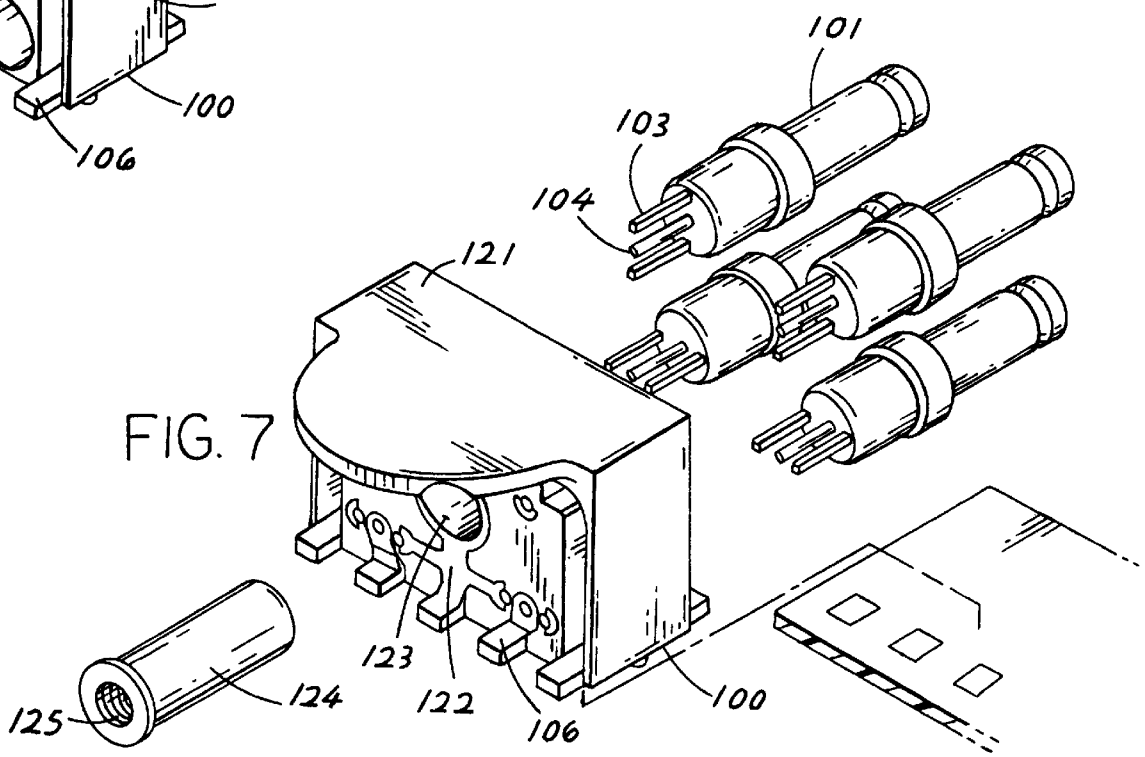
Figure 6:
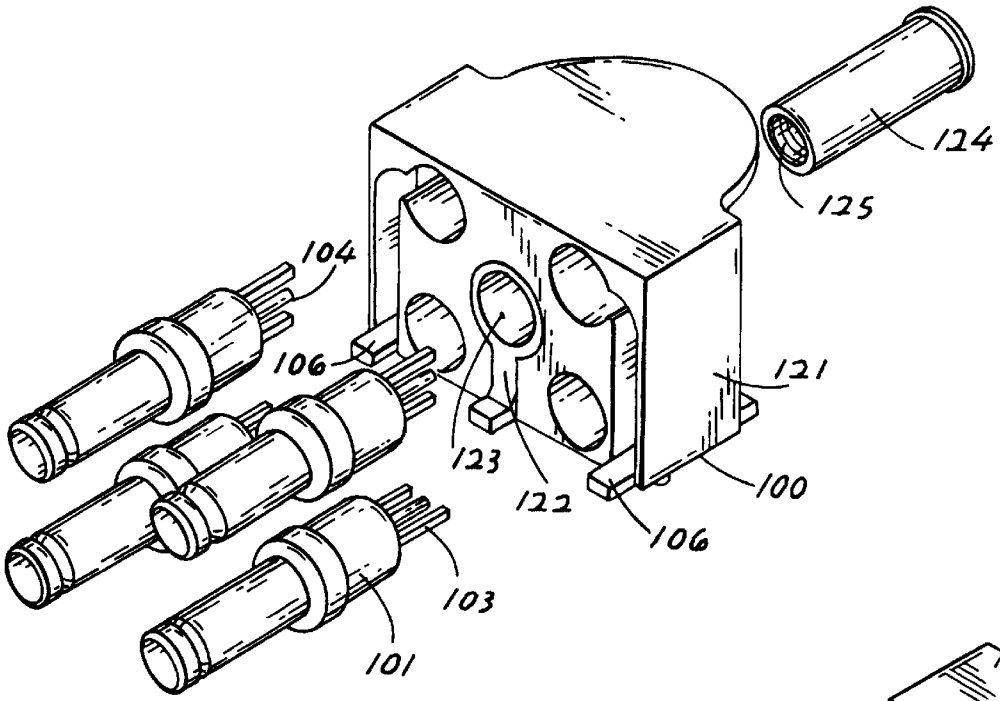

FIG. 2 is a cross section of FIG. 1 taken vertically through the centre, FIG. 3 is an isometric view of the adapter of FIGS. 1 and 2 taken from the front and slightly above, FIG. 4 is an isometric view of another adapter constructed in accordance with the invention together with 4 RF coaxial connectors, FIG. 5 is an isometric view of the adapter shown in FIG. 4 together with the 4 RF coaxial connectors but taken from the opposite side of the adapter, FIG. 6 is an isometric view of a further adapter constructed in accordance with the invention together with 4 RF coaxial connectors and a screw threaded insert, and FIG. 7 is an isometric view of the adapter shown in FIG. 6 together with the 4 RF coaxial connectors and the screw threaded insert but taken from the opposite side of the adapter and showing a circuit board on which the connector can be mounted.

Throughout FIGS. 1 to 3 and 4 to 7 the same reference numerals are used for similar parts.

Referring to FIGS. 1, 2 and 3, there is shown an adapter (10) formed as a Moulded Interconnect Device (MID) for attaching to a PCB 20 with a lower surface 21 of the body resting on the circuit board. MID technology allows the adapter to be moulded in plastics preferably as a single piece which is then selectively plated with a electrically conductive material so that certain areas can carry an electrical signal.

The adapter (10) includes a molded dielectric plastic body 12 which has a plated body area (1) and a plated through hole (4), for carrying electrical signals. Hole 4 has a hole axis 32 which is horizontal when the upper face 34 of the circuit board lies in a horizontal plane. Platings 22, 24, respectively coat the body area 1 and the hole 4. The two plated areas (1,4) are electrically independent of each other. Solder tabs (3,5) form attachment means and allow the plated areas (1,4) to be directly connected to traces 26, 28 on a PCB but these could equally be substituted by other means of electrical attachment such as plated pins. The solder tabs 3,4 comprise horizontal projections at the bottom 30 of the body. The electrical independence between the plated body area (1) and the plated through hole (4) is due to the non-plated areas (9) which are dielectrics and separate the two electrical signal carrying areas. The required impedance between the two signal carrying areas (1,4) could be adjusted according to, for example, the spacing between the plated through hole and the plated body area (1). The electrical continuity between the plated through hole and the PCB is provided by a conductive layer formed by a plated link (2) to a solder tab (3). The plated link 2 is a plating track that extends on the outside of the body on a vertical body surface 9 and on the projection formed by the plastic in the solder tab 3, to the bottom 40 of the projection. The plated body area and the plating on the plastic part of the soldered tabs 5 also form a track that extends along a vertical body surface 41.

The plated through hole (4) may form a female contact for receiving a male contact ot an RF connector. Alternatively, an electrical contact (7) has a first part 50 that may lie in inserted into the hole to provide a male contact for connection to a female contact of an RF connector. The contact (7) may be an interference fit with the hole (4), providing a first electrical signal path communicating between the contact (7) and the plated through hole (4) to the solder tab (3). A contact shoulder 52 abuts the walls at the end of the hole, and a projecting second end 54 projects from the hole. An outer shell of the RF connector (not shown) would mate with a connector interface (6) of the adapter, providing a second electrical signal path communicating between the outer shell of the RF connector and solder tabs (5) via the plated body area (1) and the connector interface (6). The first and second signal paths could then be connected to the PCB by the solder tabs (3) and (5) respectively which are coplanar. The connector interface 6 comprises walls forming a second hole 42 that is larger than the first hole 2, with the walls of the second hole plated by a plating portion 44 that merges with the plating 22. The second hole 42 is coaxial with the first hole 4, but the second hole terminates at 46.

The contact (7) could be moulded as part of the adapter (10) as long as electrical continuity between the contact (7) and the plated through hole (4) is ensured by, for example, continuing the plated through hole through the contact.

Various other modifications to the shown embodiment are possible, for example the plated through hole (4) could be replaced by a plated track running around the outside of the adapter from the contact (7) to the solder tab (3). A dielectric area would be formed on either side of the plated track to ensure electrical independence from the plated body area (1).

Referring to FIGS. 4 and 5, an alternative construction of an adapter (100) for attaching to a PCB is shown with four RF coaxial connectors (101). As in the previous embodiment, the adapter (100) is constructed employing Moulded Interconnect Device (MID) technology.

The adapter (100) has a non-plated body area (102) and a plated body area (111) and a number of plated through holes (107,110), which form contacts, for accepting the contacts (103,104) of the RF connectors (101). The plated through holes (110) are electrically connected to conductive layers in the form of first plated tracks (105) that extend between the holes (110) and attachment means in the form of solder tab (113) extending over the end of projection (106) allowing electrical signal communication between a track on a PCB and the coaxial connector centre contacts (104) once the adapter is attached to the PCB. Further solder tabs (114) are each connected by further plated tracks (108) to plated through holes or slots (112). The plated through slots (112) electrically connect the plated tracks (108) to the plated body area (111) which in turn is electrically connected to the plated through holes (107), thus allowing electrical signal communication between the PCB and coaxial outer contacts (103) once the adapter is attached to the PCB. The plated tracks (105) are electrically independent of each other and of the tracks (108). The solder tabs (113,114) are coplanar and allow the adapter (100) to be directly connected to tracks on the PCB but this could equally be substituted by other means of electrical attachment such as plated pins.

Once the RF connectors (101) are mated with the adapter (100), their contacts (103,104) are soldered into place e.g. by reflow soldering.

Referring to FIGS. 6 and 7, a further alternative construction of an adapter (100) for attaching to a PCB is shown with four RF coaxial connectors (101). As in the previous embodiments, the adapter (100) is constructed employing Moulded Interconnect Device (MID) technology.

The adapter (100) is formed by a two part moulding process. A substructure (106,122, 123) is moulded from a first platable plastic which then has a superstructure (121) moulded around it, the plastic of the superstructure being resistant to plating. When the adapter is then plated, the exposed areas of the substructure (106,122,123) accept the plating whilst those of the superstructure (121) do not.

In the shown construction, a common tracking area (122) is used to connect the outer contacts (103) of RF connectors (101) to a solder tab (106). A plated through hole (123) is adapted to accept a metal insert (124). The insert (124) has a screw threaded hole (125) allowing a housing (not shown) that holds the RF connectors (101) to be screwed to the adapter (100) ensuring a secure fit. The plating of the hole (123) and the metal insert (124) allow the housing to be connected to ground, if necessary.

In addition to the embodiments and variations described, other modifications and variations are possible. For example although only mating to interference fit and solder fit connectors has been shown, the construction could be easily modified to allow mating with other connectors such as locking connectors, the connectors could be, for example, cable connectors or u-link connectors. It would also be possible to produce an embodiment of the invention where more than one connector type could be mated with by the provision of a number of different mating portions. In addition the invention could be varied according to the number of signals each individual cable or connector could carry so that the invention could connect for example a multi-core cable according to the principles described.

Whilst the embodiments described have employed MID technology employing selective plating of conductive layers to provide electrical interconnectors by for example using different plastics materials one of which accepts plating and one of which does not, any alternative techniques for providing conductive layers or tracks on the surface of a plastic body can be employed e.g. selective etching of a coating or application of conductive layers or tracks by masking and sputtering. Such constructions are intended to fall within the scope of this invention.

What is claimed is:

1. An adaptor for mounting on a circuit board that has an upper face and that has a plurality of conductive board traces, where said adaptor is useful for connecting contacts of a connector to said board traces, comprising:

a molded plastic body that has walls forming at least one hole that is formed to receive one of said contacts of said connector, said body having an outer surface and said body having a bottom part for lying at the level of said circuit board, with said hole having a hole axis that is horizontal when said board upper face lies in a horizontal plane;

a plurality of metal plating tracks that are plated onto said plastic body and that are electrically isolated from each other, with one of said plating tracks covering the walls of said hole, and with a first of said plating tracks extending from said hole generally downward on the outside of said body to a location on said body bottom part which lies over one of said board traces, to thereby enable said first track to be easily soldered to one of said board traces;

said body has primarily vertical surface portions lying in primarily vertical planes when said circuit board upper face is horizontal, with said vertical body surface portions having lower ends, with said body having a plurality of projections extending horizontally from said lower end of said vertical body surface portions;

said tracks extend along said projections to said body lower end.

2. The adaptor described in claim 1 including said circuit board with said traces, wherein:

said second plating is soldered to a second of said traces on said circuit board, and said first plating is soldered to a first of said traces on said circuit board.

3. An adaptor for mounting on a circuit board upper face, where the circuit board has a plurality of board traces, and for connecting the board traces to inner and outer contacts of a coaxial connector, comprising:

a plastic molded body having a bottom and having a bottom surface for resting facewise on said board upper face, said body having walls forming a first hole with a hole axis that is horizontal when said body bottom surface lies in a horizontal plane, and said body having walls forming a second hole of larger diameter than said first hole and coaxial with said first hole;

first and second platings that plate said walls of said first hole and that plate said walls of said second hole, respectively;

said body has at least first and second projections projecting largely horizontally from said bottom of said body, with said second plating extending to said second projection and along said second projection to said body bottom surface, and with said first plating extending from said first hole and on the outside of said body and generally downward to said first projection and along said first projection to said body bottom surface.

4. The adaptor described in claim 3 wherein:

said body has first and second ends that are spaced along said axis, with said walls forming said second hole lying only at said body first end and with said first hole extending completely through said body and having first and second opposite hole ends so the coaxial connector plugs into said first end of said body;

said first projection lies at said second end of said body, and so said first trace lies at said second end of said body opposite where said coaxial connector plugs into said body.

* * * * *